US005851124A

United States Patent [19]

Young et al.

[11] Patent Number: 5,851,124

[45] Date of Patent: Dec. 22, 1998

[54] LOCKING WIRE CONNECTOR

[76] Inventors: Bruce Lynn Young, 944 S Spruce, Casper, Wyo. 82601; Katherine Marie Young, P.O. Drawer 41450, Tucson, Ariz. 85717-1450

[21] Appl. No.: 711,008

[22] Filed: Sep. 11, 1996

[51] Int. Cl.[6] ..... H01R 4/24

[52] U.S. Cl. ..... 439/427; 174/84 C

[58] Field of Search ..... 439/427, 393, 439/438–441; 174/84 C, 85

[56] References Cited

U.S. PATENT DOCUMENTS

| | | | |
|---|---|---|---|
| 2,093,403 | 9/1937 | Sertillange | 174/85 |
| 2,799,721 | 7/1957 | Floyd, Jr. | 174/84 C |
| 2,863,132 | 12/1958 | Sowa | 174/84 C |
| 4,990,098 | 2/1991 | Neidecker et al. | 439/207 |
| 5,318,458 | 6/1994 | Thörner | 439/427 |
| 5,503,568 | 4/1996 | Pryce | 439/427 |
| 5,618,200 | 4/1997 | Norgaard | 439/427 |

*Primary Examiner*—Gary F. Paumen
*Assistant Examiner*—Tho D. Ta

[57] ABSTRACT

A locking wire connecting device having a plurality of cylindrical housings of circular cross section, each of the housings containing plural rings of plural symmetric inwardly curving teeth, and an alloy pin embedded in a plastic retaining wall. A wire is inserted into each of the respective housings without removal of the wire insulation, until the pin fully contacts the respective wire and pushes the wire insulation firmly into the inwardly curving teeth, which will resist slippage or removal of the wire. This allows for quick, reliable and simple connecting of cut wires in an enclosed space.

1 Claim, 3 Drawing Sheets

LOCKING WIRE CONNECTOR

BACKGROUND OF THE INVENTION

1. Field of the Invention

This invention relates in general to a wire connector, and in particular to a self-locking non-crimping, non-soldering wire connector.

2. Description of the Prior Art

Most of the wire connecting systems known today involve the stripping of wire insulation with a wire-stripper, placing the bare wire into a connector with a small, metal hub and crimping the stripped portion of the wire with a wire crimper. Corrosion, excess voltage drop and resistance to tension forces have not been sufficiently addressed. The use of a wire stripper and crimper is required and is often difficult when working in a small enclosed space. No device is known that connects cut wires without additional tools, while minimizing voltage drop and corrosion.

SUMMARY OF THE INVENTION

The principal objective of the present invention is to provide a device which will securely fasten cut wires without stripping the insulation or crimping the wire, requiring neither additional tools nor use of a soldering device.

It is also an objective that the connector be protective against corrosion and minimize voltage drop through wire connections.

Another objective is to simplify connecting wires when working in an enclosed space and minimize the time to connect cut wires.

The foregoing objectives can be accomplished by providing a device that has tapered, inward curving teeth placed circularly around the interior of the connector housing, and a copper alloy pin placed at the inside of a connecting wall, which would swell the wire insulation, causing it to be firmly locked in place by the interior teeth. The preferred embodiment joins two wires together, each passing through a housing containing at least four rings of teeth.

DETAILED DESCRIPTION OF INVENTION

Figure 1:
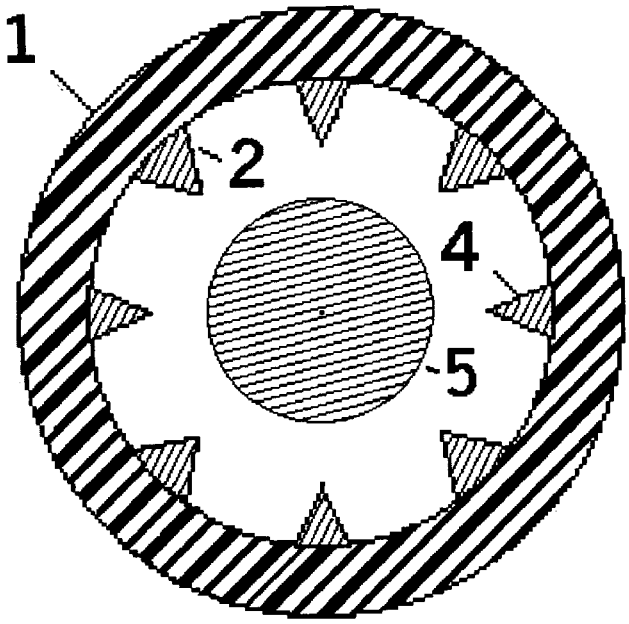
FIG. 1 is a front perspective view of the plastic housing of the wire connector showing the teeth.
Figure 2:
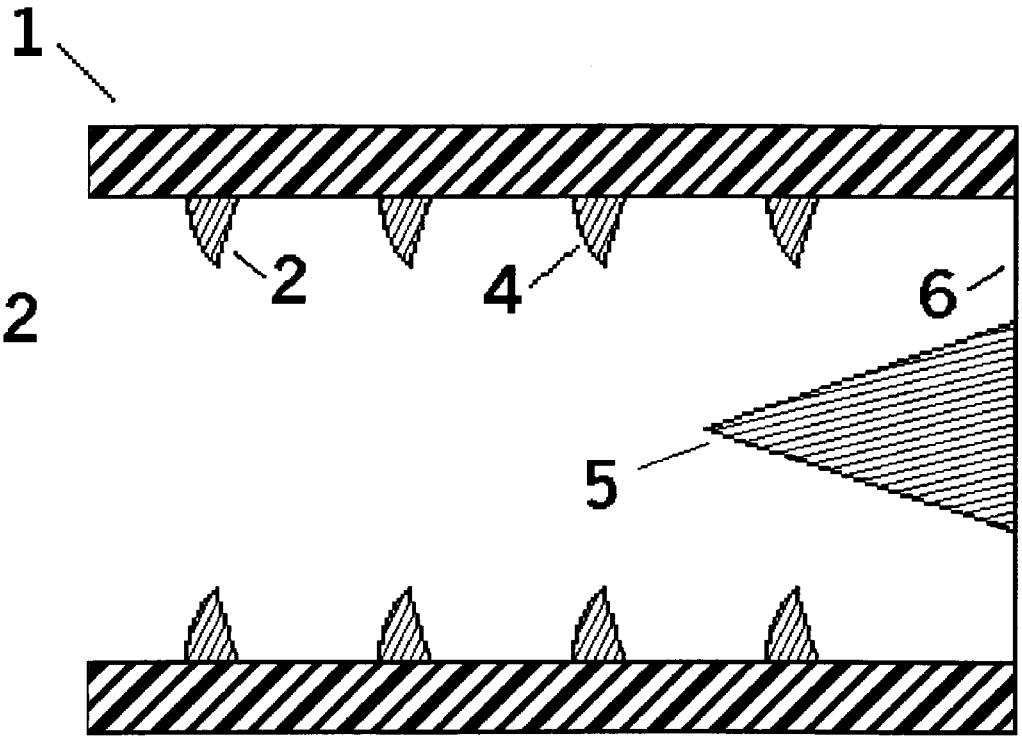
FIG. 2 is a side fragmentary view of plastic housing showing the pin and rows of teeth.
Figure 3:
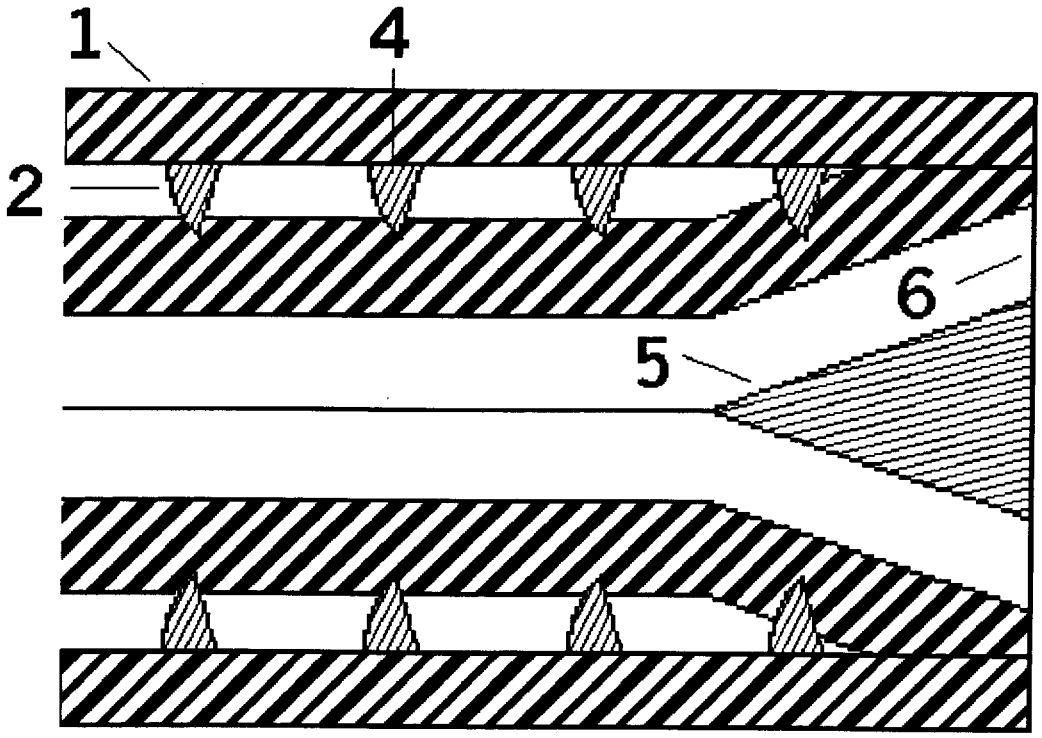
FIG. 3 is a cutaway side perspective view of an inserted wire locked into the plastic housing.
Figure 4A:
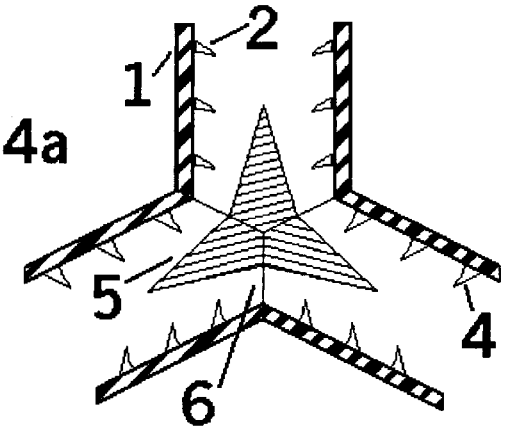
FIGS. 4(*a*)–4(*c*) illustrate top views of multiple embodiments of wire connectors.
Figure 4B:
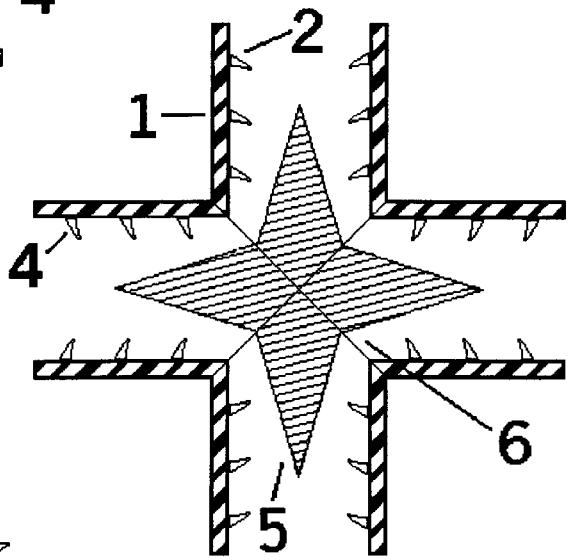
Figure 4C:
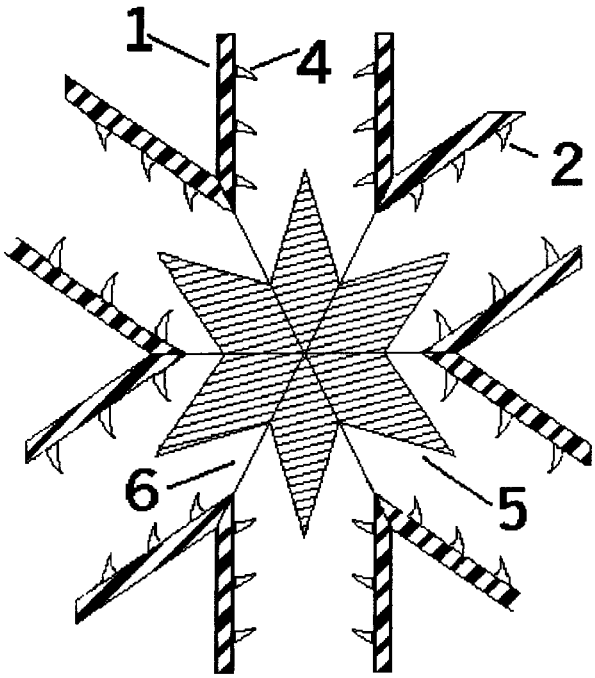

As shown in the drawings, the preferred wire connecting device in accordance with the present invention includes a plurality of plastic housings 1, each of the housings 1 having at least four rows 2 of eight plastic tapered inward curving teeth 4, a thin plastic dividing wall 6 and a tapered copper alloy pin 5. The tapered copper alloy pin 5 stationed in the thin plastic dividing wall 6, swells the wire insulation 7 against the teeth 4. In use, once a plurality of electrical wires

8 have been cut to the desired length, no additional tools are required to connect the wires 8. Each of the wires 8 is inserted directly into a respective one of the housings 1 of the connecting device, until the tapered pin 5 fully contacts the wire 8 and pushes the wire insulation firmly into the teeth 4. The inward curving teeth would resist outward applied forces. The tapered pins 5 provide a means of electrical connection between said wires 8 with less voltage drop. The retention of the original wire insulation 7 in conjunction with the plastic connector 1 provides greater protection against moisture and corrosion. Faster and easier installation in enclosed spaces is achievable without the need for additional tools, such as a crimper and stripper. Spliced and cut wires could also be quickly and securely repaired and connected.

Refer now to FIG. 1, which is an overall drawing of preferred embodiment of the invention. Because wires 8 are produced in different sizes and require different connectors, different embodiments could be utilized, including multiple connectors, such as three or four way connectors, and eye or lug connectors. Connectors can be sized in a full range to handle wires of any dimension. Drawings are shown with approximate proportions, intended to provide ratios when sizing wires.

This invention fulfills the objectives by having curved tapered inward directed teeth that would allow for the smooth passage of an inserted wire, yet create a strong resistance against the removal of the wires, by swelling the wire insulation with a copper alloy pin which runs through the dividing wall. The insulation on the wire is retained, minimizing the exposed surface, which reduces corrosion, while the pin provides a better electrical connection and decreases voltage drop.

The foregoing description of the preferred embodiment of the invention has been presented for the purpose of illustration. It is not intended to be exhaustive or to limit the invention to the precise form disclosed. Modifications and variations are possible in light of the above. It is intended that the scope of the invention be limited not by this detailed description, but rather by the claims appended hereto.

What is claimed is:

1. An electrical connector for connecting cut un-stripped wires, comprising:

a plurality of plastic cylindrical outer housings, each of said housings having a plurality of symmetric rings of teeth on an inside surface thereof, said teeth of each said ring are spaced apart and curved inward into a same direction of wire insertion for providing smooth passage of the inserted wire;

a retaining wall disposed in each of said housings; and an electrical terminal secured in said retaining wall, wherein the terminal comprises a tapered pin for piercing into the end of said wire, characterized in that the tapered pin longitudinally penetrates into the end of the cut un-stripped wire, forcing the end to swell and make firm contact with the inward curving teeth, which will resist slippage or removal of the wire, wherein the tapered pins are electrically connected to each other so as to electrically interconnect the wires.

* * * * *